US011370077B2

(12) United States Patent
Liu et al.

(10) Patent No.: US 11,370,077 B2
(45) Date of Patent: Jun. 28, 2022

(54) DEVICE FOR REMOVING BURRS FROM BOLT HOLES OF ALUMINUM ALLOY WHEEL

(71) Applicant: CITIC Dicastal CO., LTD., Hebei (CN)

(72) Inventors: Huiying Liu, Qinhuangdao (CN); Song Li, Qinhuangdao (CN)

(73) Assignee: CITIC DICASTAL CO., LTD., Hebei (CN)

( * ) Notice: Subject to any disclaimer, the term of this patent is extended or adjusted under 35 U.S.C. 154(b) by 847 days.

(21) Appl. No.: 16/124,544

(22) Filed: Sep. 7, 2018

(65) Prior Publication Data

US 2019/0076980 A1 Mar. 14, 2019

(30) Foreign Application Priority Data

Sep. 14, 2017 (CN) ..... 201710824681.7

(51) Int. Cl.
*B24B 9/00* (2006.01)
*B24B 41/04* (2006.01)
*B24B 41/06* (2012.01)

(52) U.S. Cl.
CPC ..... *B24B 9/005* (2013.01); *B24B 41/04* (2013.01); *B24B 41/067* (2013.01)

(58) Field of Classification Search
CPC .. B24B 5/06; B24B 5/065; B24B 5/08; B24B 5/40; B24B 5/44; B24B 29/005; B24B 29/04; B24B 27/0076; B24B 27/0069; B24B 9/005; B24B 41/04; B24B 41/067; B24B 33/02; B24B 9/00; B24B 33/027; B23D 79/04; B23B 2215/08;
(Continued)

(56) References Cited

U.S. PATENT DOCUMENTS 3,016,934 A * 1/1962 Smyser ..... B60C 25/135 157/14
5,899,795 A * 5/1999 Penza ..... B24B 5/40 451/61

(Continued)

FOREIGN PATENT DOCUMENTS

CN 101386137 A 3/2009
CN 102581653 A 7/2012

(Continued)

*Primary Examiner* — Tyrone V Hall, Jr.
*Assistant Examiner* — Makena S Markman
(74) *Attorney, Agent, or Firm* — Cooper Legal Group, LLC

(57) ABSTRACT

A device for removing burrs from bolt holes of an aluminum alloy wheel is composed of a frame, a support plate, clamping guide rails, clamping motors, clamping sliders, support rods, clamping wheels, racks, gears, a brush disc, a support sleeve, a feed slide, guide pillars, a feed linear motor, a pitch adjustment linear motor, a conical pitch head, horizontal push rods, sliders, springs, burr brush drive motors and burr brushes. The device can meet the requirements of an automatic production line and can be used for automatically removing burrs from the inner walls of bolt hole countersinks. The device has certain flexibility and can adjust pitch diameter, can be used for removing burrs from bolt hole countersinks having different diameters, and is easy to manufacture, economical, practical and convenient to operate.

3 Claims, 5 Drawing Sheets

(58) Field of Classification Search
CPC ... B23B 2220/08; A46B 13/02; A46B 13/008; A46B 2200/3093; B08B 1/04; B08B 1/002; B23Q 1/0054; B23Q 1/01; B23Q 1/012; B23Q 1/015; B23Q 1/25; B23Q 1/40; B23Q 1/46; B23Q 1/62; B60B 2310/00; B60B 2310/20; B60B 2310/60; B60S 3/042
USPC ..... 157/14, 16, 18, 21
See application file for complete search history.

(56) References Cited

U.S. PATENT DOCUMENTS

| | | | | |
|---|---|---|---|---|
| 6,926,593 | B1 * | 8/2005 | Carroll | B24B 9/04 451/358 |
| 10,010,992 | B2 * | 7/2018 | Xue | B24B 29/005 |
| 10,022,834 | B2 * | 7/2018 | Xue | B24B 29/005 |
| 10,160,051 | B2 * | 12/2018 | Xue | B23D 79/04 |
| 10,160,085 | B2 * | 12/2018 | Xue | B24B 29/04 |
| 10,213,890 | B2 * | 2/2019 | Xue | B24B 47/10 |
| 10,220,484 | B2 * | 3/2019 | Xue | B24B 9/04 |
| 10,279,432 | B2 * | 5/2019 | Luo | B23K 26/0838 |
| 2009/0100617 | A1 * | 4/2009 | Wilkins | A46B 15/0055 15/52.1 |
| 2012/0279667 | A1 * | 11/2012 | Carawan | B60C 25/00 157/14 |
| 2016/0353873 | A1 * | 12/2016 | Xue | A46B 13/02 |

FOREIGN PATENT DOCUMENTS

| | | | |
|---|---|---|---|
| CN | 102975095 | A | 3/2013 |
| CN | 203599923 | U | 5/2014 |
| CN | 104439374 | A | 3/2015 |
| CN | 104493702 | A | 4/2015 |
| CN | 104589199 | A | 5/2015 |
| CN | 105921723 | A | 9/2016 |
| CN | 205734401 | U | 11/2016 |
| CN | 106808339 | A | 6/2017 |
| KR | 20150062292 | A | 6/2015 |

* cited by examiner

DEVICE FOR REMOVING BURRS FROM BOLT HOLES OF ALUMINUM ALLOY WHEEL

CROSS-REFERENCE TO RELATED APPLICATIONS

The present application claims benefit of Chinese Patent Application No. 201710824681.7, filed on Sep. 14, 2017, the contents of which are hereby incorporated by reference in its entirety.

BACKGROUND

After an aluminum alloy wheel is machined and drilled, there will be burrs on the machined and cast junctions on the inner walls of bolt hole countersinks. These burrs are mostly removed manually, causing many disadvantages, e.g., the burrs are not removed completely, cutters scratch the inner walls of the countersinks during removal, the countersinks are not uniform or smooth after the removal, the roundness of the countersinks is affected, etc. Some wheels are special in shape, and the bolt hole countersinks are deep, thus increasing more difficulty for manually removing the burrs. In addition, with the improvement of the automation level, production and detection of wheels are gradually automated. An automatic device that meets flow production is urgently needed for removing burrs from bolt holes. Based on the current situation, this patent provides a device for removing burrs from bolt holes of a wheel, which can be used for removing burrs from the inner walls of bolt hole countersinks and meets the requirements of an automatic production line.

SUMMARY

The present disclosure relates to the technical field of removing burrs after machining of a wheel, and specifically, relates to a device for removing burrs from bolt holes of an aluminum alloy wheel.

The object of the present disclosure is to provide a device for removing burrs from bolt holes of a wheel, which meets the requirements of an automatic production line and can be used for automatically removing burrs from the inner walls of bolt hole countersinks.

A device for removing burrs from bolt holes of a wheel is composed of a frame, a support plate, clamping guide rails, clamping motors, clamping sliders, support rods, clamping wheels, racks, gears, a brush disc, a support sleeve, a feed slide, guide pillars, a feed linear motor, a pitch adjustment linear motor, a conical pitch head, horizontal push rods, sliders, springs, burr brush drive motors and burr brushes.

The support plate is fixed on the frame, and two clamping guide rails and two racks are symmetrically fixed on the support plate; and a clamping slider is mounted on clamping guide rail, a clamping motor is fixedly mounted on a bottom plate of the clamping slider, the output end of the clamping motor is connected to a gear, the gear is engaged with the rack, a support rod is fixedly mounted on a top plate of the clamping slider, and a clamping wheel is fixed on the support rod. The clamping motors are started to drive the gears to rotate, the clamping sliders move on the guide rails under the engagement of the gears and the racks, and the wheel can be positioned and clamped when the four clamping motors synchronously drive the clamping sliders to move toward the center.

The feed linear motor is fixed in the upper center of the frame, has an output end fixedly connected to the feed slide, and controls the up-and-down movement of the feed slide under the guidance of the four guide pillars.

The support sleeve and the pitch adjustment linear motor are both fixed on the feed slide, the brush disc is fixed on the support sleeve, slide ways in the same number of bolt holes are formed in the brush disc, and the angles between the slide ways are equal, and are 90 degrees in the presence of four slide ways, 72 degrees in the presence of five slide ways and 60 degrees in the presence of six slide ways. The sliders are mounted on the slide way, one end of the slider is fixedly connected to a spring and the other end is fixedly connected to a horizontal push rod, and the conical pitch head is mounted at the output end of the pitch adjustment linear motor. When the conical pitch head moves down, all the horizontal push rods are pushed to move synchronously outward, so that all the sliders move synchronously outward to adjust the pitch diameter. When the conical pitch head moves down, the springs are compressed, and when the conical pitch head moves up, the sliders restore to the initial positions under the action of the spring force.

A burr brush drive motor is mounted below each slider, and a burr brush is mounted at the output end of the burr brush drive motor, and the rotation of the burr brush is controlled by the burr brush drive motor. The burr brushes are conical so as to be capable of removing burrs from bolt hole countersinks having different diameters.

The working process of the device is as follows: first, the pitch adjustment linear motor is started, and the positions of the burr brushes are adjusted according to the pitch diameter of a wheel in the flow production; when a hub arrives below the burr brushes through a flow roller path, the four clamping motors are synchronously started to drive the clamping sliders to synchronously move toward the center of the wheel so as to position and clamp the wheel; then, the feed linear motor is started to drive the feed slide to be fed down, at the same time, the burr brush drive motors are started to drive the burr brushes to rotate, and the burr brushes begin brushing burrs when descending to proper positions; and finally, the feed slide moves up after the burrs are removed, the clamping wheels are released, the wheel from which the burrs are removed completely is transported to the next process, and so on. When the number of bolt holes of the wheel in the flow production changes, the brush disc having a corresponding number of holes is replaced.

The device can meet the requirements of an automatic production line and can be used for automatically removing burrs from the inner walls of bolt hole countersinks. The device has certain flexibility and can adjust pitch diameter, can be used for removing burrs from bolt hole countersinks having different diameters, and is easy to manufacture, economical, practical and convenient to operate.

LIST OF REFERENCE SYMBOLS

Figure 1:
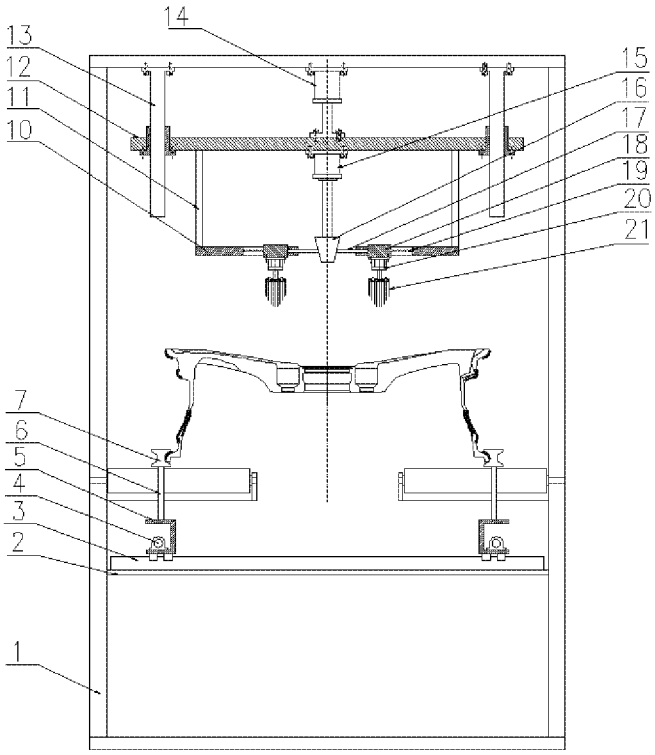
FIG. 1 is a front view of a device for removing burrs from bolt holes of a wheel according to the present disclosure.
Figure 2:
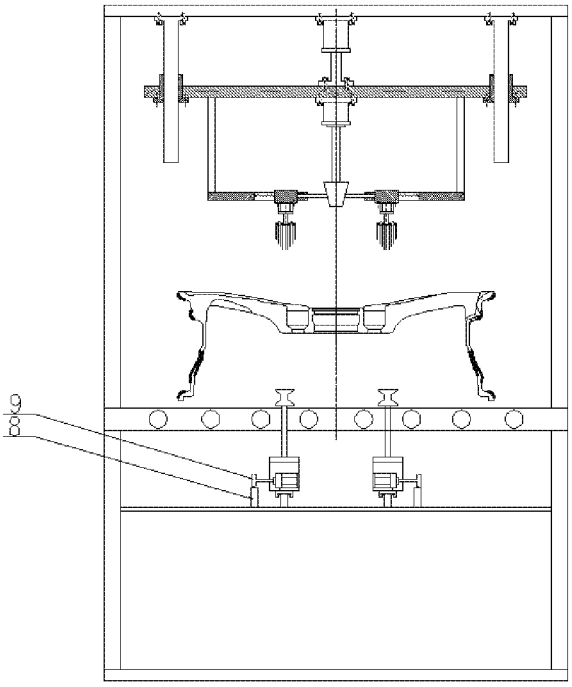
FIG. 2 is a left view of the device for removing burrs from bolt holes of a wheel according to the present disclosure.
Figure 3:
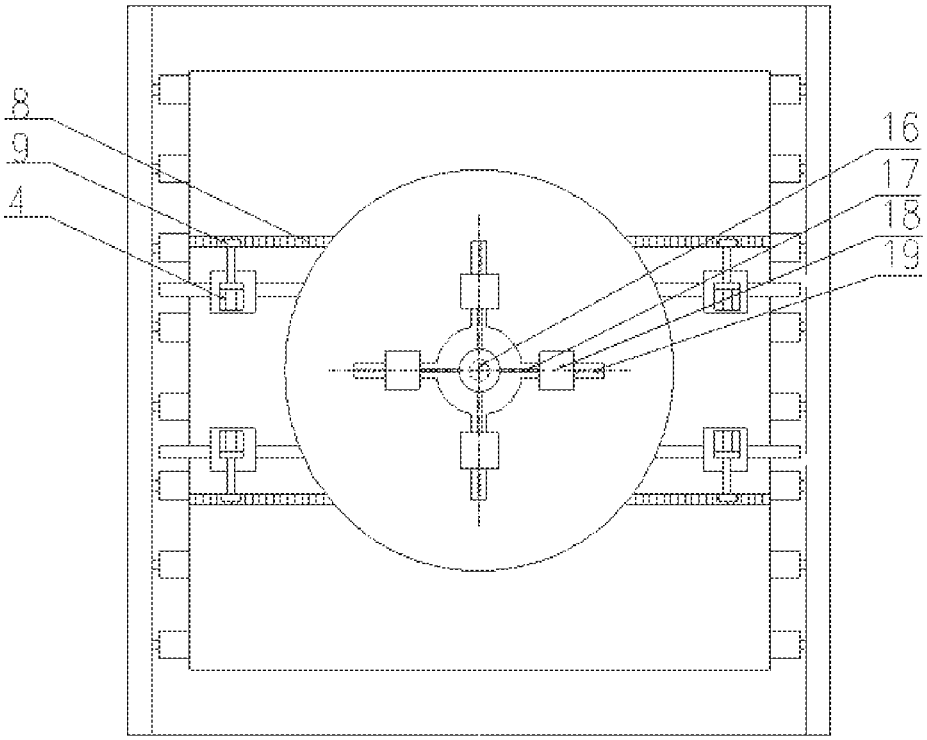
FIG. 3 is a top view of the device for removing burrs from bolt holes of a wheel according to the present disclosure.
Figure 4:
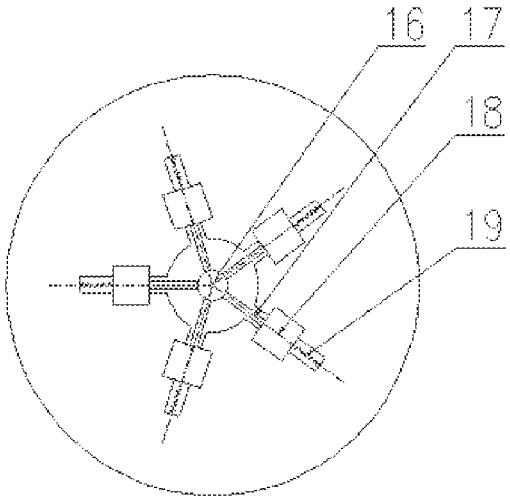
FIG. 4 is a partial view of a five-hole brush disc of the device for removing burrs from bolt holes of a wheel according to the present disclosure.
Figure 5:
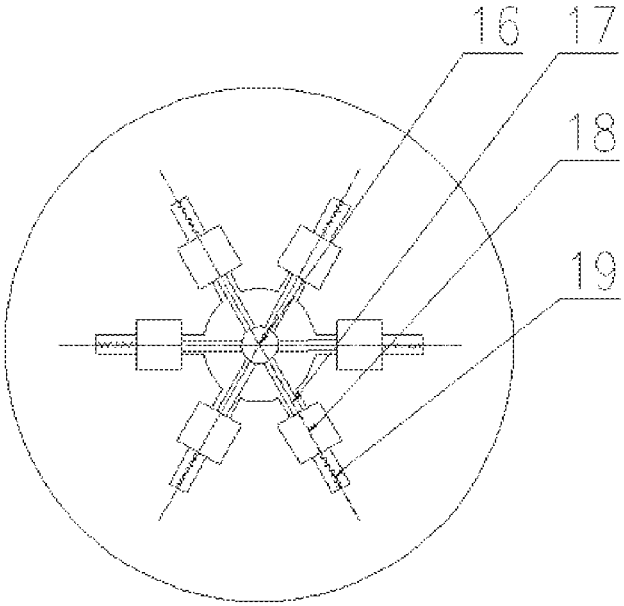
FIG. 5 is a partial view of a six-hole brush disc of the device for removing burrs from bolt holes of a wheel according to the present disclosure.

1 frame
2 support plate
3 clamping guide rail
4 clamping motor
5 clamping slider
6 support rod
7 clamping wheel
8 rack
9 gear
10 brush disc
11 support sleeve
12 feed slide
13 guide pillar
14 feed linear motor
15 pitch circle adjustment linear motor
16 conical pitch head
17 horizontal push rod
18 slider
19 spring
20 burr brush drive motor
21 burr brush

DETAILED DESCRIPTION

The details and working conditions of the specific device proposed by the present disclosure will be described below in combination with the accompanying drawings.

A device for removing burrs from bolt holes of a wheel is composed of a frame 1, a support plate 2, clamping guide rails 3, clamping motors 4, clamping sliders 5, support rods 6, clamping wheels 7, racks 8, gears 9, a brush disc 10, a support sleeve 11, a feed slide 12, guide pillars 13, a feed linear motor 14, a pitch adjustment linear motor 15, a conical pitch head 16, horizontal push rods 17, sliders 18, springs 19, burr brush drive motors 20 and burr brushes 21.

The support plate 2 is fixed on the frame 1, and two clamping guide rails 3 and two racks 8 are symmetrically fixed on the support plate 2; and a clamping slider 5 is mounted on clamping guide rail 3, a clamping motor 4 is fixedly mounted on a bottom plate of the clamping slider 5, the output end of the clamping motor 4 is connected to a gear 9, the gear 9 is engaged with the rack 8, a support rod 6 is fixedly mounted on a top plate of the clamping slider 5, and a clamping wheel 7 is fixed on the support rod 6. The clamping motors 4 are started to drive the gears 9 to rotate, the clamping sliders 5 move on the guide rails under the engagement of the gears and the racks, and the wheel can be positioned and clamped when the four clamping motors 4 synchronously drive the clamping sliders 5 to move toward the center.

The feed linear motor 14 is fixed in the upper center of the frame 1, has an output end fixedly connected to the feed slide 12, and controls the up-and-down movement of the feed slide 12 under the guidance of the four guide pillars 13.

The support sleeve 11 and the pitch adjustment linear motor 15 are both fixed on the feed slide 12, the brush disc 10 is fixed on the support sleeve 11, slide ways in the same number of bolt holes are formed in the brush disc 10, and the angles between the slide ways are equal, and are 90 degrees in the presence of four slide ways, 72 degrees in the presence of five slide ways and 60 degrees in the presence of six slide ways. The sliders 18 are mounted on the slide way, one end of the slider 18 is fixedly connected to a spring 19 and the other end is fixedly connected to a horizontal push rod 17, and the conical pitch head 16 is mounted at the output end of the pitch adjustment linear motor 15. When the conical pitch head 16 moves down, all the horizontal push rods 17 are pushed to move synchronously outward, so that all the sliders 18 move synchronously outward to adjust the pitch diameter. When the conical pitch head 16 moves down, the springs 19 are compressed, and when the conical pitch head 16 moves up, the sliders 18 restore to the initial positions under the action of the spring force.

A burr brush drive motor 20 is mounted below each slider 18, and a burr brush 21 is mounted at the output end of the burr brush drive motor 20, and the rotation of the burr brush 21 is controlled by the burr brush drive motor 20. The burr brushes 21 are conical so as to be capable of removing burrs from bolt hole countersinks having different diameters.

The working process of the device is as follows: first, the pitch adjustment linear motor 15 is started, and the positions of the burr brushes 21 are adjusted according to the pitch diameter of a wheel in the flow production; when a hub arrives below the burr brushes through a flow roller path, the four clamping motors 4 are synchronously started to drive the clamping sliders 5 to synchronously move toward the center of the wheel so as to position and clamp the wheel; then, the feed linear motor 14 is started to drive the feed slide 12 to be fed down, at the same time, the burr brush drive motors 20 are started to drive the burr brushes 21 to rotate, and the burr brushes 21 begin brushing burrs when descending to proper positions; and finally, the feed slide 12 moves up after the burrs are removed, the clamping wheels 7 are released, the wheel from which the burrs are removed completely is transported to the next process, and so on. When the number of bolt holes of the wheel in the flow production changes, the brush disc having a corresponding number of holes is replaced.

The device can meet the requirements of an automatic production line and can be used for automatically removing burrs from the inner walls of bolt hole countersinks. The device has certain flexibility and can adjust pitch diameter, can be used for removing burrs from bolt hole countersinks having different diameters, and is easy to manufacture, economical, practical and convenient to operate.

The invention claimed is:

1. A device for removing burrs from bolt holes of a wheel, comprising: a frame, a support plate, two clamping guide rails, four clamping motors, clamping sliders, support rods, clamping wheels, two racks, gears, a brush disc, a support sleeve, a feed slide, a pitch adjustment linear motor, a conical pitch head, horizontal push rods, sliders, springs, burr brush drive motors and burr brushes, wherein the support plate is fixed on the frame, and the two clamping guide rails and the two racks are symmetrically fixed on the support plate; each of the clamping sliders is mounted on a respective one of the two clamping guide rails, each of the four clamping motors is fixedly mounted on a bottom plate of a respective one of the clamping sliders, an output end of each of the four clamping motors is connected to a respective one of the gears, each of the gears is engaged with a respective one of the two racks, each of the support rods is fixedly mounted on a top plate of a respective one of the clamping sliders, and each of the clamping wheels is fixed on a respective one of the support rods, the four clamping motors are started to drive the gears to rotate, the clamping sliders move on the guide rails under engagement of the gears and the two racks, and the wheel can be positioned and clamped when the four clamping motors synchronously drive the clamping sliders to move toward a center, the support sleeve and the pitch adjustment linear motor are both fixed on the feed slide, the brush disc is fixed on the support sleeve, slide ways are formed in the brush disc, and the sliders are mounted on the slide ways, one end of each of the sliders is fixedly connected to a respective one of the springs and the other end of each of the sliders is fixedly connected to a respective one of the horizontal push rods, and the conical pitch head is mounted at an output end of the pitch adjustment linear motor, when the conical pitch head moves down, all the horizontal push rods are pushed to move synchronously outward, so that all the sliders move synchronously outward to adjust a pitch diameter; and when the conical pitch head moves down, the springs are compressed, and when the conical pitch head moves up, the sliders restore to initial positions under the action of a spring force, and each of the burr brush drive motors is mounted below a respective one of the sliders, and each of the burr brushes is mounted at an output end of a respective one of the burr brush drive motors, and a rotation of each of the burr brushes is controlled by the respective one of the burr brush drive motors to remove burrs from the bolt holes of the wheel.

2. The device for removing burrs from the bolt holes of the wheel according to claim 1, wherein each of the slide ways corresponds to a respective one of the bolt holes, angles between the slide ways are equal, and are 90 degrees in the presence of four slide ways, 72 degrees in the presence of five slide ways and 60 degrees in the presence of six slide ways.

3. The device for removing burrs from the bolt holes of the wheel according to claim 1, wherein the burr brushes are conical.

* * * * *